United States Patent [19]

Pell

[11] 4,241,774

[45] Dec. 30, 1980

[54] GOLF TUBE SEPARATOR INSERT

[76] Inventor: Terrell G. Pell, 2701 McIntosh, NE., Grand Rapids, Mich. 49505

[21] Appl. No.: 67,054

[22] Filed: Aug. 16, 1979

[51] Int. Cl.[3] ..... A63B 55/00

[52] U.S. Cl. ..... 150/1.5 R

[58] Field of Search ..... 150/1.5 R, 1.5 B, 1.5 C; 206/315 R, 443, 446

[56] References Cited

U.S. PATENT DOCUMENTS 3,554,255 1/1971 Mangan ..... 150/1.5 R

*Primary Examiner*—Donald F. Norton

*Attorney, Agent, or Firm*—Price, Heneveld, Huizenga & Cooper

[57] ABSTRACT

The specification discloses a golf tube or club separator comprised of a polyethylene foam disc with holes for golf club tubes as with several perforated lines spaced successively inwardly from the periphery of the disc whereby a portion or portions of the disc can be broken away to allow one disc to accommodate a wide range of golf bags having different sized openings.

19 Claims, 3 Drawing Figures

GOLF TUBE SEPARATOR INSERT

BACKGROUND OF THE INVENTION

The present invention relates to golf tube or golf club separators. Golfers typically place polyethylene tubes in their bags and insert the handles of their clubs into the tubes. A myriad of prior art devices have been developed to separate these tubes.

For example, U.S. Pat. No. 2,114,870 to Calkins discloses a sponge rubber separator comprised of a disc with a downwardly depending apron which fits over the top of the golf bag. There are holes in the disc through which the golf clubs can be inserted. Such a disc could also be used to separate golf club tubes and for purposes of the present invention, the separation of golf clubs per se or the separation of golf club tubes will be considered generally equivalent for purposes of the present invention.

In U.S. Pat. No. 3,554,255, Mangan discloses a separator disc for insertion into the top of the golf bag opening. It is made of polyurethane or foam rubber and includes a bottom channel to seat over cross braces in the golf bag. It also includes a plurality of holes therethrough to accommodate golf club tubes.

U.S. Pat. No. 3,980,115 to Longo discloses a similar type of separator made of an expanded foam polypropylene dioxide-based triol. It too is inserted into the upper opening of a golf club bag and includes a plurality of holes for golf club tubes.

In U.S. Pat. No. 2,879,819, Turnbull discloses a molded polyethylene separator molded to the shape of a portion of the bag opening. It too includes openings for golf clubs or golf club tubes.

The problem with all of the prior art devices is that the manufacturer has to provide a plurality of different sized discs and a plurality of different shaped discs to accommodate the numerous bags on the market with different sized openings. While the compressible foam discs such as those disclosed in Longo and Mangan will compress somewhat to accommodate different sized and different shaped bags, they cannot effectively accommodate the full range of golf club bags without being made of a material which is so flexible and floppy that it will not hold its proper shape in normal use.

SUMMARY OF THE INVENTION

The present invention comprises a golf tube separator disc made of a material which is semi-rigid such that it will hold its disc shape configuration and won't distort under normal use, but which is compressible such that the disc can be compressed at least somewhat to accommodate different sized and shaped openings in the tops of different golf bags. The disc includes at least one perforation line spaced inwardly from the peripheral edge of the disc whereby a portion of the disc can be broken away at the perforation line to increase the range of sizes of golf bags into which the disc can be fitted.

Thus, the disc separator of the present invention can accommodate a wide range of golf club bags having different sized and shaped openings, and yet is made of a material which is sufficiently rigid that it will not distort or flex under normal usage. Further, it does not need to have any special channels or the like to fit over cross braces in the golf bag to thereby increase its rigidity.

These and other objects, advantages and features of the present invention will be more fully understood and appreciated by reference to the written specification and appended drawings.

DESCRIPTION OF THE PREFERRED EMBODIMENT

Figure 1:
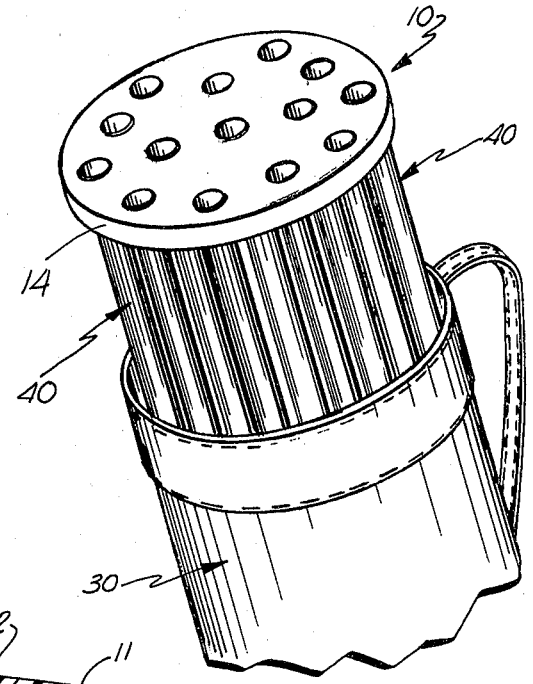
FIG. 1 is a perspective view showing the golf tube separator and a plurality of tubes inserted therein exploded slightly out of the top of a golf club bag.
Figure 3:
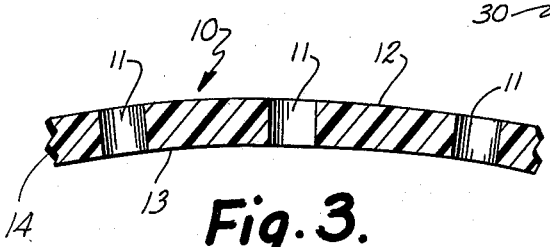
FIG. 3 is a cross sectional view taken along plane III—III of FIG. 2.
Figure 2:
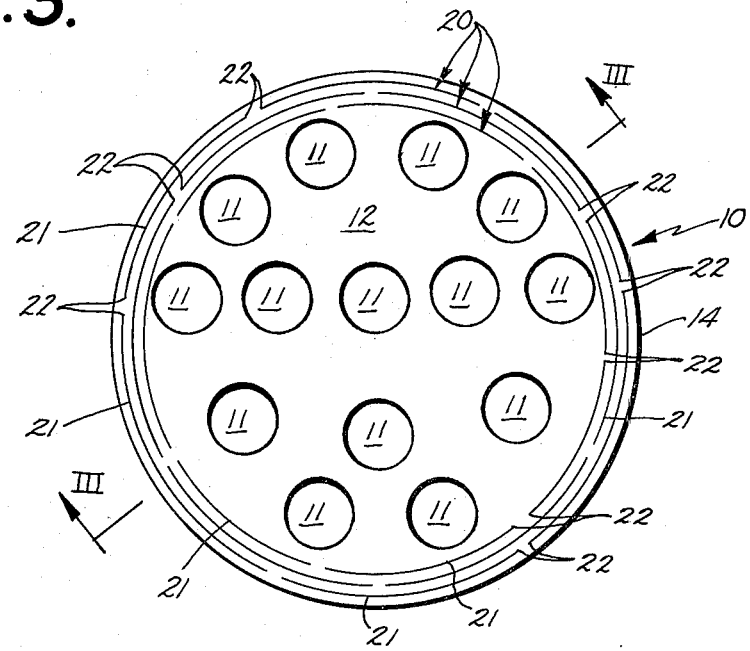
FIG. 2 is a top plan view of the golf tube separator disc made in accordance with the present invention.

Referring to FIGS. 1-3 it will be seen that the golf tube separator disc 10 of the present invention is a disc-shaped member having holes 11 therethrough through which golf tubes 40 can be inserted. Disc 10 is made of a compressible foam material such that it can be fitted snugly into the top of a golf bag 30. It also includes three perforation lines 20 spaced progressively inwardly from the peripheral edge 14 of disc 10 such that portions of disc 10 can be progressively broken away.

Disc 10 is preferably cut from a sheet of polyethylene foam material. Disc 10 includes a top surface 12 and an opposite bottom surface 13 bounded by a peripheral edge 14.

Disc 10 should be made of a material which is semi-rigid such that it will hold its disc-shaped configuration and won't distort under normal usage. It is believed that some foam rubbers and polyurethane foams would be too soft and flexible to adequately hold their shape in normal usage. They would tend to bend and flop and perhaps even pop out of the opening in the top of bag 30 unless additional holding means were provided.

Yet, the material must be sufficiently flexible and compressible that the disc can be compressed at least somewhat to accommodate different sized and shaped openings in golf bags. A preferred material for use in the present invention is a polyethylene foam having a density of from two to three pounds per cubic feet. The cell size of such a foam is approximately one mm on the average. It has a tensile strength of approximately twenty psi and undergoes approximately sixty percent elongation (per ASTM test D 1564). It has a tear strength of approximately six pounds per inch. I have found "Ethafoam 220 Plank", a trademarked product available from Dow Chemical Company, to be a preferred material for disc 10. The manufacturer refers to this material as being "flexible." However, it is also semi-rigid in that it does not flex under its own weight or when one waves it in the air. Also, it does not flex or distort under normal usage. These are important properties for the disc 10.

One advantage of a polyethylene foam material is that it forms a generally closed pore skin. It is preferable that top surface 12 be a closed pore skin surface so that dirt has less tendency to collect in the surface of disc 10.

It is also preferable that disc 10 be bowed upwardly slightly as shown in FIG. 3. Peripheral edge 14 is thus canted inwardly as one proceeds downwardly from top 12. This makes it easier to insert the sloped peripheral edge 14 of disc 10 into the top of a golf bag 30.

This slight curvature to disc 10 can be achieved by cutting a two inch thick slab of polyethylene foam material through the middle so that each half is one inch thick. Circular discs 10 are then cut out of each half and will naturally tend to bow into the radiused configuration as illustrated in FIG. 3. Further, the smooth skinned top surface of the half slab will comprise the upper convex surface 12.

Disc 10 can be made of a compressible material that will have less tendency to collapse or shift in normal usage, as distinguished from other materials, because of the provision of perforation lines 20. Each of the three perforation lines 20 comprises a series of cuts 21 extending from top 12 to bottom 13 of disc 10. In each perforation line 20, each cut 21 is separated from each successive cut 21 by a relatively short bridge 22 of foam material. Each cut 21 is from one to two inches long and each bridge between successive cuts is from one-sixteenth to about three-sixteenths of an inch. It is important that the bridges 22 in successive perforation lines 21 are staggered relative to one another. That is, they do not lie on the same radial line. This helps to prevent one from inadvertently separating two peripheral segments simultaneously.

The overall diameter of a disc 10, which is generally circular in configuration, is approximately nine and one-half inches. Each perforation line 20 is separated by one-eighth to one-quarter of an inch. The three perforation lines 21 are generally concentric circles spaced successively closer to the center of disc 10, away from the peripheral edge 14 thereof. Holes 11 are approximately one and one-eighth inches in diameter. As noted above, disc 10 is preferably approximately one inch thick.

In use, one takes disc 10 and determines approximately at what size it will fit best into the opening in his golf bag 30. Then, if necessary, he breaks away one, two or three outer segments along an appropriate perforation line 20 so that disc 10 has approximately the proper diameter to fit into the opening in bag 30. He then compresses it slightly and forces it down into the top of bag 30. Because peripheral edge 14 is canted inwardly slightly as one proceeds downwardly from top surface 12, it is easier for the user to insert disc 10 into the top of bag 30. He then inserts tubes 40 in place through holes 11, fills them with assorted drivers, niblicks, spoons, mashies, wedges and irons, and heads for his favorite golf course.

Of course, it is understood that the above is merely a preferred embodiment of the invention and that various changes and alterations can be made without departing from the spirit and broader aspects thereof as set forth in the appended claims, which are to be interpreted in accordance with the principles of patent law.

The embodiments of the invention in which an exclusive property or privilege is claimed are defined as follows:

1. A golf tube separator insert for golf bags comprising:

a disc having top and bottom surfaces and a peripheral edge joining same, said disc being made of a material which is semi-rigid such that it will hold a disc-shape configuration and won't distort under normal use, but which is compressible such that said disc can be compressed at least somewhat to accommodate different sized and shaped openings in the top of different golf bags; a plurality of holes in said disc adapted to receive golf club separator tubes; at least one perforation line defined by a series of cuts serially spaced by small bridges of disc material between successive cuts, said cuts extending from said top to said bottom of said disc, said perforation line defining a closed loop and being spaced inwardly from said peripheral edge of said disc whereby a portion of said disc can be broken away at said perforation line and the range of sizes of golf bags into which said disc can be fitted is increased.

2. The separator of claim 1 which includes a plurality of said perforation lines spaced successively further inwardly from said periphery of said disc.

3. The separator of claim 2 in which the bridges of material in one perforation line are staggered with respect to the bridges of material in the other perforation lines such that one has less tendency to inadvertently tear more than one perforation line.

4. The separator of claim 3 wherein the distance between successive perforation lines is from about one-eighth to about one-quarter of an inch.

5. The separator of claim 1 or 4 wherein each said cut in each perforation line is from about one to about two inches long and wherein each said bridge between successive cuts is from approximately one-sixteenth to approximately three-sixteenths of an inch.

6. The separator of claim 5 wherein said disc is made of polyethylene foam having a density of from about two to about three pounds per cubic foot.

7. The separator of claim 5 in which said peripheral edge of said disc is inclined inwardly as one proceeds from said top surface to said bottom surface of said disc.

8. The separator of claim 7 wherein said disc upper surface is slightly convex and said disc lower surface is slightly concave.

9. The separator of claim 7 in which said top surface of said disc has a closed cell skin such that dirt and the like do not tend to collect in said separator.

10. The separator of claims 1, 2, 3 or 4 in which said peripheral edge of said disc is inclined inwardly as one proceeds from said top surface to said bottom surface of said disc.

11. The separator of claim 10 wherein said disc upper surface is slightly convex and said disc lower surface is slightly concave.

12. The separator of claim 10 wherein said disc is made of polyethylene foam having a density of from about two to about three pounds per cubic foot.

13. The separator of claim 12 in which said top surface of said disc has a closed cell skin such that dirt and the like do not tend to collect in said separator.

14. The separator of claims 1, 2, 3 or 4 wherein said disc is made of polyethylene foam having a density of from about two to about three pounds per cubic foot.

15. The separator of claim 14 in which said top surface of said disc has a closed cell skin such that dirt and the like do not tend to collect in said separator.

16. The separator of claims 1, 2, 3 or 4 in which said disc is made of a foamed plastic material.

17. The separator of claim 16 in which said top surface of said disc has a closed cell skin such that dirt and the like do not tend to collect in said separator.

18. The separator of claim 17 wherein said disc upper surface is slightly convex and said disc lower surface is slightly concave.

19. The separator of claim 16 wherein each said cut in each perforation line is from about one to about two inches long and wherein each said bridge between successive cuts is from approximately one-sixteenth to approximately three-sixteenths of an inch.

* * * * *